US009456668B1

(12) United States Patent
Lafayette, Jr.

(10) Patent No.: US 9,456,668 B1
(45) Date of Patent: Oct. 4, 2016

(54) AURICLE COVERING

(71) Applicant: Willard Lafayette, Jr., Columbus, MS (US)

(72) Inventor: Willard Lafayette, Jr., Columbus, MS (US)

( * ) Notice: Subject to any disclaimer, the term of this patent is extended or adjusted under 35 U.S.C. 154(b) by 84 days.

(21) Appl. No.: 14/570,092

(22) Filed: Dec. 15, 2014

(51) Int. Cl.
*A44C 7/00* (2006.01)
*A44C 15/00* (2006.01)
*G09F 21/02* (2006.01)

(52) U.S. Cl.
CPC ..... *A44C 7/009* (2013.01); *G09F 21/026* (2013.01)

(58) Field of Classification Search
CPC ..... A44C 7/00; A44C 7/009; A44C 7/007; G09F 21/026
See application file for complete search history.

(56) References Cited

U.S. PATENT DOCUMENTS 2,281,357 A * 4/1942 Johnson ..... A61F 11/06 2/209
3,144,663 A * 8/1964 McKinstry ..... A61F 11/06 2/209
D299,119 S * 12/1988 Frederick ..... D11/40
4,911,287 A 3/1990 Speers
5,184,482 A 2/1993 Cloud
D344,611 S * 2/1994 Hordis ..... D29/112
6,568,212 B2 5/2003 Jacobs
8,627,824 B2 * 1/2014 Koehler ..... A61F 11/004 128/858
2003/0000235 A1 * 1/2003 Dienhart ..... B60H 1/3229 62/199

* cited by examiner

*Primary Examiner* — Jack W Lavinder

(74) *Attorney, Agent, or Firm* — Crossley & Stevenson Intellectual Property Law

(57) ABSTRACT

An auricle covering including an outer wall and an inner wall having a substantially auricle shape. A connection wall between the inner wall and outer wall creates a channel. The channel has a width that conforms to the helix of an auricle. There is at least one aperture on a lower portion of the inner wall. The at least one aperture provides access for a backing of an earring to fit therethrough ensuring a proper fit around an auricle when the auricle covering is in use. An indicia is on a front side of the outer wall providing customization of each auricle covering and allows a user to show team spirit and support of a desired logo, team, church, company or a specific design.

6 Claims, 2 Drawing Sheets

AURICLE COVERING

CROSS-REFERENCE TO RELATED APPLICATIONS

Not Applicable

FEDERALLY SPONSORED RESEARCH OR DEVELOPMENT

Not Applicable

INCORPORATION BY REFERENCE OF MATERIAL SUBMITTED ON A COMPACT DISK

Not Applicable

BACKGROUND OF THE INVENTION

Various types of ear jewelry are known in the prior art. However, what is needed is an auricle covering that is worn over the helix of an auricle. Many people are avid sports fans and love to support their favorite team by wearing articles of clothing including hats, shirts, jackets, pants and sock. They love to display other devices sporting the team name and colors in their home and on their vehicles.

Many companies have marketing tools with their company logo that are given out freely to spread the word about their products or company.

The present device provides an additional way of showing their loyalty or team sprit by wearing the device on the auricle of the ear.

FIELD OF THE INVENTION

The present invention relates to ear jewelry, and more particularly, to an auricle covering.

SUMMARY OF THE INVENTION

The general purpose of the present auricle covering, described subsequently in greater detail, is to provide an auricle covering which has many novel features that result in an auricle covering which is not anticipated, rendered obvious, suggested, or even implied by prior art, either alone or in combination thereof.

To accomplish this, the present auricle covering includes an outer wall and an inner wall. Each of the outer wall and the inner wall has a front side, a rear side, a right side, a left side. A continuous front edge is disposed between the front side and the rear side. Each of the front side and the rear side has an upper portion and a lower portion. Each of the outer wall and the inner wall has a substantially auriform shape.

The inner wall lower portion has a length greater than a length of the outer wall lower portion. The length of the lower portion that is greater than the length of the upper portion is designed to sit behind the lobule.

The upper portion has a protrusion on each of the right side of the respective outer wall and inner wall in a position extending from approximately midway the respective outer wall and inner wall toward the front edge.

A connection wall is disposed between the rear side of each the outer wall and the inner wall. The connection wall terminates in a top end disposed proximal a midpoint of the protrusion and a bottom end.

A continuous channel is disposed between the connection wall and the rear side of each of the outer wall and the inner wall. The channel has a width conforming to a width of a helix of an auricle and is configured to be placed over the helix of the auricle ensuring a proper fit.

There is at least one aperture centrally disposed on the length of the inner wall lower portion extending beyond the bottom end of the connection wall. The at least one aperture has a size and a shape configured to receive a backing of an earring therethrough.

An indicia is disposed on the outer wall front side. The indicia is a distinguishing mark such as a logo, symbol or other design. The indicia allows the auricle covering to be unique to each user. The indicia promotes pride, loyalty, commitment and enthusiasm as the user desires while the auricle covering is in use.

Thus has been broadly outlined the more important features of the present auricle covering so that the detailed description thereof that follows may be better understood and in order that the present contribution to the art may be better appreciated.

BRIEF DESCRIPTION OF THE DRAWINGS

Figures

DETAILED DESCRIPTION OF THE DRAWINGS

Figure 1:
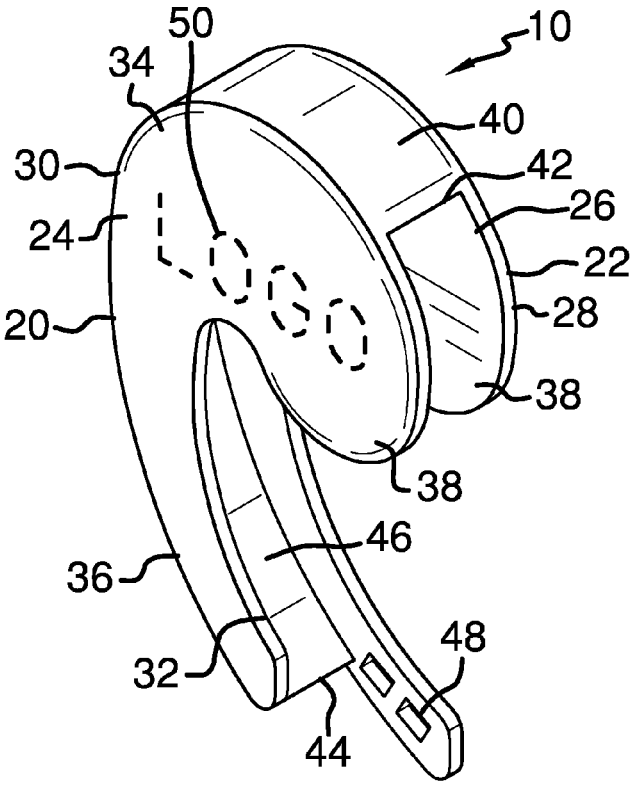
FIG. 1 is an isometric view.
Figure 2:
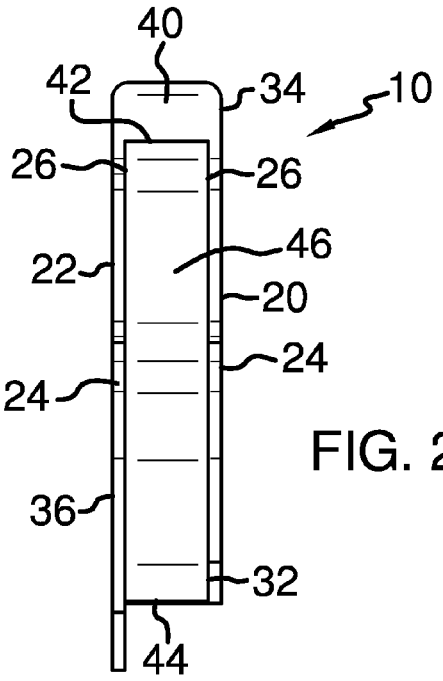
FIG. 2 is a right side elevation view.
Figure 3:
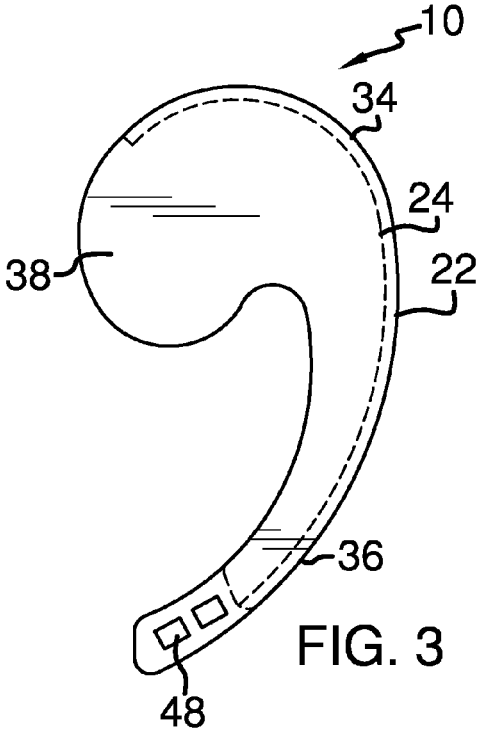
FIG. 3 is a rear elevation view.
Figure 4:
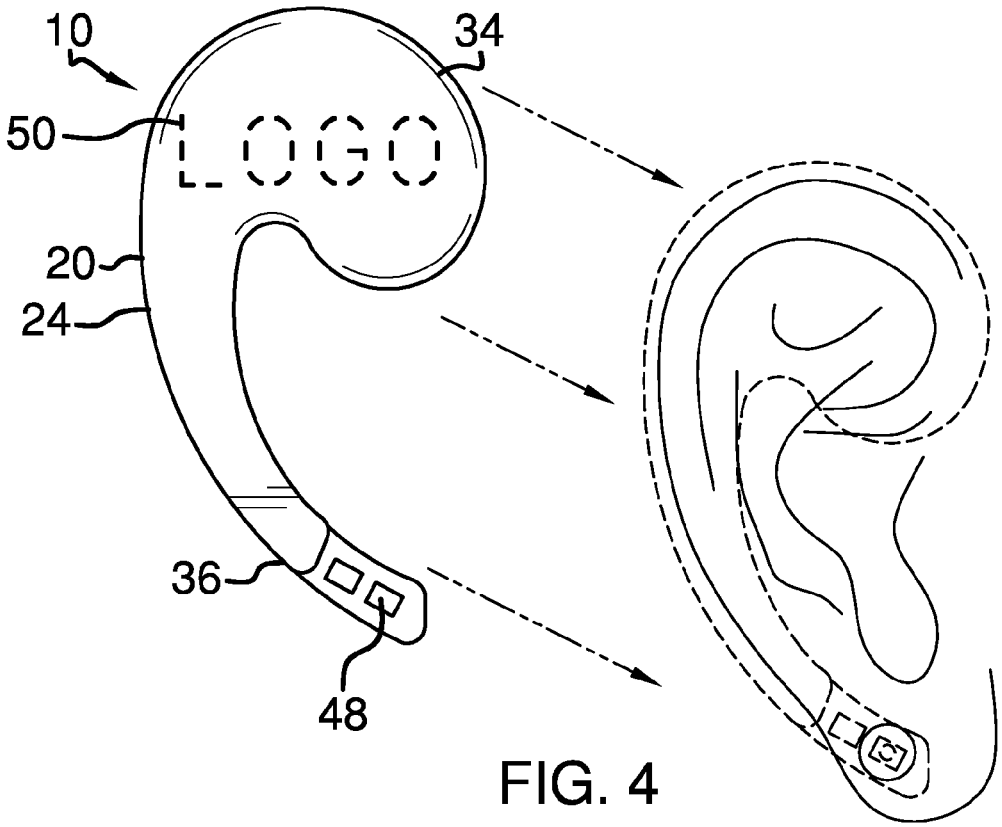
FIG. 4 is an exploded in-use view.
Figure 5:
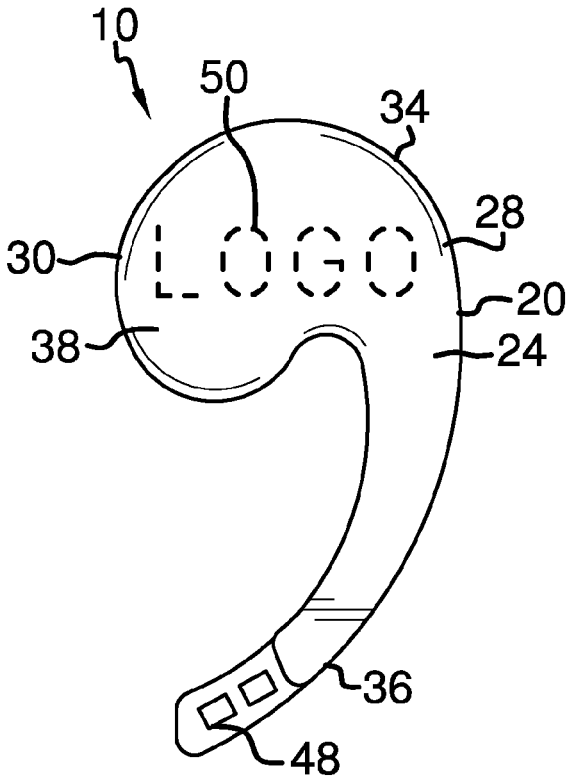
FIG. 5 is a front elevation view devised for use on a left auricle.

With reference now to the drawings, and in particular FIGS. 1 through 5 thereof, an example of the instant auricle covering employing the principles and concepts of the present auricle covering and generally designated by the reference number 10 will be described.

Referring to FIGS. 1 through 5 the present auricle covering 10 is illustrated. The auricle covering 10 includes an outer wall 20 and an inner wall 22. Each of the outer wall 20 and the inner wall 22 have a front side, 24 a rear side 26, a right side 28, a left side 30. A continuous front edge 32 is disposed between the front side 24 and the rear side 26. Each of the front side 24 and the rear side 26 has an upper portion 34 and a lower portion 36. Each of the outer wall 20 and the inner wall 22 has a substantially auriform shape providing a proper fit around the auricle.

The inner wall 22 lower portion 36 has a length greater than a length of the outer wall 20 lower portion 36. The length of the inner wall 22 lower portion 36 that is greater than the length of the outer wall 20 lower portion 36 is designed to sit behind the lobule of the auricle.

The upper portion 34 of each of the outer wall 20 and the inner wall 22 has a protrusion 38 on the right side 28 of each of the respective outer wall 20 and inner wall 22 in a position extending from approximately midway the respective outer wall 20 and inner wall 22 toward the front edge 32.

A connection wall 40 is disposed between the rear side 26 of each the outer wall 20 and the inner wall 22. The connection wall 40 terminates in a top end 42 disposed proximal a midpoint of the protrusion 38 and a bottom end 44.

A continuous channel 46 is disposed between the connection wall 40 and the rear side 26 of each of the outer wall

20 and the inner wall 22. The channel 46 has a width conforming to a width of a helix of an auricle and is configured to be placed over the helix of the auricle ensuring a proper fit.

There is at least one aperture 48 centrally disposed on the length of the inner wall 22 lower portion 36 extending beyond the bottom end 44 of the connection wall 40. The at least one aperture 48 has a size and a shape configured to receive a backing of an earring therethrough providing a proper fit when a user is wearing at least an earring and the auricle covering 10.

An indicia 50 is disposed on the outer wall 20 front side 24. The indicia 50 is a distinguishing mark such as a logo, symbol or other design. The indicia 50 allows the auricle covering 10 to be unique to each user. The indicia 50 promotes pride, loyalty, commitment and enthusiasm as the user desires while the auricle covering 10 is in use.

What is claimed is:

1. An auricle covering devised to fit onto an auricle, the auricle covering comprising:

an outer wall;

an inner wall, each of the outer wall and the inner wall having a front side, a rear side, a right side, a left side, and a continuous front edge disposed between the front side and the rear side, each of the front side and the rear side having an upper portion, a lower portion, the upper portion having a protrusion on the right side of each of the respective outer wall and inner wall in a position extending from approximately midway the respective outer wall and inner wall toward the front edge;

a connection wall disposed between the rear side of each the outer wall and the inner wall, the connection wall terminating in a top end disposed proximal a midpoint of the protrusion and a bottom end; and a continuous channel disposed between the connection wall and the rear side of each of the outer wall and the inner wall;

wherein the channel has a width conforming to a width of a helix of an auricle, wherein the channel is configured to be placed over the helix of the auricle.

2. The auricle covering of claim 1 wherein the inner wall lower portion has a length greater than a length of the outer wall lower portion;

wherein the inner wall lower portion extends beyond the bottom end of the connection wall.

3. The auricle covering of claim 2 further comprising at least one aperture centrally disposed on the length of the inner wall lower portion extending beyond the bottom end of the connection wall.

4. The auricle covering of claim 3 wherein the at least one aperture has a size and a shape configured to receive a backing of an earring therethrough.

5. The auricle covering of claim 4 further comprising an indicia disposed on the outer wall front side.

6. An auricle covering devised to fit onto an auricle, the auricle covering comprising:

an outer wall;

an inner wall;

each of the outer wall and the inner wall having a front side, a rear side, a right side, a left side, and a continuous front edge disposed between the front side and the rear side, each of the front side and the rear side having an upper portion, a lower portion, the upper portion having a protrusion on the right side of each of the respective outer wall and inner wall in a position extending from approximately midway the respective outer wall and inner wall toward the front edge;

a connection wall disposed between the rear side of each the outer wall and the inner wall, the connection wall terminating in a top end disposed proximal a midpoint of the protrusion and a bottom end;

a continuous channel disposed between the connection wall and the rear side of each of the outer wall and the inner wall;

at least one aperture centrally disposed on the length of the inner wall lower portion extending beyond the bottom end of the connection wall; and an indicia disposed on the outer wall front side;

wherein the channel has a width conforming to a width of a helix of an auricle, wherein the channel is configured to be placed over the helix of the auricle;

wherein the inner wall lower portion has a length greater than a length of the outer wall lower portion;

wherein the at least one aperture has a size and a shape configured to receive a backing of an earring therethrough; and wherein each of the outer wall and the inner wall has a substantially auriform shape.

* * * * *